US009427032B2

(12) United States Patent
Robinson et al.

(10) Patent No.: US 9,427,032 B2
(45) Date of Patent: Aug. 30, 2016

(54) GARMENT WITH HIDDEN PROTECTIVE PADDING

(71) Applicant: GRINDZCO, LLC, Breckenridge, CO (US)

(72) Inventors: Kevin M. Robinson, Barrington, RI (US); Robin H. Robinson, Barrington, RI (US)

(73) Assignee: Grindzco, LLC, Barrington, RI (US)

( * ) Notice: Subject to any disclaimer, the term of this patent is extended or adjusted under 35 U.S.C. 154(b) by 0 days.

(21) Appl. No.: 14/194,321

(22) Filed: Feb. 28, 2014

(65) Prior Publication Data

US 2014/0325730 A1 Nov. 6, 2014

Related U.S. Application Data

(63) Continuation of application No. PCT/US2012/053541, filed on Aug. 31, 2012.

(60) Provisional application No. 61/529,624, filed on Aug. 31, 2011.

(51) Int. Cl.

| | |
|---|---|
| ***A41D 1/08*** | (2006.01) |
| ***A41D 13/00*** | (2006.01) |
| ***A41D 13/05*** | (2006.01) |
| ***A41D 13/015*** | (2006.01) |

(Continued)

(52) U.S. Cl.

CPC ..... *A41D 13/0543* (2013.01); *A41D 13/015* (2013.01); *A41D 27/00* (2013.01); *A41D 27/02* (2013.01)

(58) Field of Classification Search

CPC ..... A41D 13/0153; A41D 13/0575; A41D 13/05; A41D 13/0543; A41D 13/0587; A41D 1/08; A41D 31/005; A41D 13/015; A41D 13/0506; A41D 13/0537; A41D 13/0568; A41D 31/0061; A41D 11/00; A41D 13/0525; A41D 13/0562; A41D 13/065; A41D 1/086; A41D 2600/10; A41D 27/02; A63B 2071/1233; A63B 71/1225; A63B 2071/1241; A63B 71/1216; A63B 2243/0045; A63B 2243/0041; A63B 69/0024; A63B 71/12; F41H 5/0492

See application file for complete search history.

(56) References Cited

U.S. PATENT DOCUMENTS

| | | | | |
|---|---|---|---|---|
| 1,669,085 | A * | 5/1928 | Guyon | 2/23 |
| 3,594,817 | A * | 7/1971 | Kelly | 2/456 |

(Continued)

FOREIGN PATENT DOCUMENTS

| | | |
|---|---|---|
| FR | 2851890 A1 | 9/2004 |
| RU | 80729 U1 | 2/2009 |
| RU | 2365318 C2 | 8/2009 |

OTHER PUBLICATIONS

International Search Report from PCT/US2012/053541 dated Dec. 6, 2012.

*Primary Examiner* — Bobby Muromoto, Jr.
(74) *Attorney, Agent, or Firm* — Foley & Lardner LLP

(57) ABSTRACT

A casual aesthetic garment constructed with hidden panels of padded material. The padding is some kind of open or closed cell foam. The outer fabric is made of a blend or nonblended fabric including cotton and/or polyester. The padding is affixed to the inside of the garment to be hidden from the outside of the garment, to give the appearance of the user not wearing a padded garment. The internal pads are affixed, and cannot be removed, to ensure the user is more protected then when not having any pads present.

18 Claims, 2 Drawing Sheets

(51) Int. Cl.

| | |
|---|---|
| ***A41D 27/02*** | (2006.01) |
| ***A41D 27/00*** | (2006.01) |
| *A41D 31/00* | (2006.01) |

(56) References Cited

U.S. PATENT DOCUMENTS

| | | | | |
|---|---|---|---|---|
| 4,325,148 | A * | 4/1982 | Livernois | 2/465 |
| 4,811,427 | A * | 3/1989 | Regan | 2/466 |
| 4,894,867 | A * | 1/1990 | Ceravolo et al. | 2/238 |
| 4,987,613 | A * | 1/1991 | Loverdi et al. | 2/23 |
| 5,052,058 | A * | 10/1991 | Mueller | 2/228 |
| 5,134,726 | A * | 8/1992 | Ross | 2/465 |
| 5,365,610 | A * | 11/1994 | Lubahn et al. | 2/23 |
| 5,539,927 | A * | 7/1996 | Holubec | 2/69 |
| 5,608,915 | A * | 3/1997 | Libit | 2/228 |
| 5,649,328 | A * | 7/1997 | Martin | 2/238 |
| 5,926,856 | A * | 7/1999 | Duval | 2/455 |
| 5,983,407 | A * | 11/1999 | McKay | 2/455 |
| 6,041,437 | A * | 3/2000 | Barker et al. | 2/82 |
| 6,182,297 | B1 * | 2/2001 | Duren et al. | 2/228 |
| 6,532,599 | B1 * | 3/2003 | Dugan | 2/228 |
| 6,789,270 | B1 * | 9/2004 | Pedrick | 2/228 |
| 6,817,029 | B2 * | 11/2004 | Mazzarolo | 2/22 |
| 7,062,789 | B1 * | 6/2006 | Blackwell | 2/79 |
| 7,533,423 | B2 * | 5/2009 | Rudolph | 2/227 |
| 7,784,116 | B2 | 8/2010 | Gallo et al. | |
| 7,793,359 | B2 * | 9/2010 | Spiewak et al. | 2/69 |
| 8,201,270 | B2 * | 6/2012 | Lee | 2/22 |
| 8,272,073 | B2 * | 9/2012 | Arensdorf et al. | 2/267 |
| 8,302,212 | B1 * | 11/2012 | Wiens | 2/24 |
| 8,438,667 | B2 * | 5/2013 | Grogro et al. | 2/228 |
| 8,438,669 | B2 * | 5/2013 | Turner | 2/456 |
| 8,719,965 | B2 * | 5/2014 | Turner et al. | 2/228 |
| 8,938,815 | B2 * | 1/2015 | Vaughn | 2/238 |
| 2002/0020000 | A1 * | 2/2002 | Garcia | 2/23 |
| 2002/0178483 | A1 * | 12/2002 | Beland | 2/22 |
| 2003/0005505 | A1 * | 1/2003 | DeMott | 2/23 |
| 2003/0056275 | A1 * | 3/2003 | Regan | 2/78.1 |
| 2003/0093852 | A1 * | 5/2003 | Webb | 2/300 |
| 2003/0150042 | A1 * | 8/2003 | Leflet et al. | 2/23 |
| 2003/0204896 | A1 * | 11/2003 | Grilliot et al. | 2/227 |
| 2005/0060782 | A1 * | 3/2005 | Sallas et al. | 2/23 |
| 2005/0066428 | A1 * | 3/2005 | Bellfy | 2/455 |
| 2006/0205303 | A1 * | 9/2006 | Nurnberg | 442/123 |
| 2006/0282938 | A1 * | 12/2006 | Jewell et al. | 2/227 |
| 2007/0044212 | A1 * | 3/2007 | Contant et al. | 2/461 |
| 2007/0101474 | A1 * | 5/2007 | Skottheim et al. | 2/69 |
| 2007/0101475 | A1 * | 5/2007 | Skottheim | 2/69 |
| 2007/0234467 | A1 * | 10/2007 | Leach et al. | 2/227 |
| 2008/0313793 | A1 * | 12/2008 | Skottheim et al. | 2/461 |
| 2010/0024104 | A1 * | 2/2010 | Sims | 2/466 |
| 2010/0024105 | A1 * | 2/2010 | Sims | 2/466 |
| 2010/0080971 | A1 * | 4/2010 | Neal | 428/213 |
| 2010/0293703 | A1 * | 11/2010 | Tezartes-Strauss et al. | 2/455 |
| 2010/0319097 | A1 * | 12/2010 | Turner | 2/22 |

* cited by examiner

GARMENT WITH HIDDEN PROTECTIVE PADDING

RELATED APPLICATIONS

This application claims priority to U.S. Provisional Application No. 61/529,624, the contents of which are incorporated herein by reference.

FIELD OF THE INVENTION

The present disclosure relates to garments suitable for sports activity or leisure, and more particularly to improved sport garments, such as, e.g., pants, shirts, and hats having one or more panels of hidden padding, thereby allowing the wearer to maintain a look of not wearing protective padding and benefit from increased protection from injury. Injury occurs when a participant in a sports related activity is not wearing the proper protection, participants will benefit from having the protection in high impact areas that this improved sport garment with hidden protective padding offers. This hidden, protective garment offers the elimination of the step of having to apply padding to the outside of clothing by offering the padding on the inside seams of the garments.

Maintaining a high level of comfort while participating in sport activities that require impact protection padding is a challenge. Protective pads have been developed for the user to be safe from impacts relating to falling, and are worn on the specific embodied areas of highest impact, such as knees and elbows. However, many sports require the participant to have a greater ability for movement, and less restriction on these important joints of the body. In these situations the user feels uncomfortable restriction from the exterior padding, and the heavy elastic straps used to keep the pads in place decrease user mobility. It is desirable then to have a garment that protects the body from the impacts of falling while allowing the wearer to have more mobility, thereby maintaining more comfortable body movement. Additionally, it is desirable to have a garment that conceals the padding from the outside, as many participants do not desire the look of wearing protective padding.

Kneepads are a typical example of a protective garment accessory suitable for sports and leisure activities. Knee Pads are tight fitting protective pads worn by bicyclists, skate boarders, scooter riders and inline skaters to protect themselves from injury. Modern protective pads typically comprise heavy elastic strapping, a protective padding material, and plastic covering.

Kneepads and other such protective garment accessories typically are strapped on over the clothing, which is uncomfortable, and a deterrent from many people to wear them. This increases their likelihood of becoming injured Padded shorts designed to more effectively protect the wearer from injury can be found in U.S. Pat. No. 6,532,599. In this garment, contoured pads are used in the garment in the impact areas, and the pads have the option to be removable. Because these pads are removable, it gives the user the option to remove the pads, and therefore become unprotected if they were to fall.

In U.S. Pat. No. 7,784,116, and in an attempt to protect the user from injury from impact, the sewn in padded sections are not removable and placed in areas of higher impact. These garments are used under the sports uniform to add additional protection to the user, but only as a secondary layer under their clothing or uniforms.

Having a garment that is fashionable to the wearer and offers a level of protection to the wearer as your only layer eliminates the added step of having to apply protective padding on the outside of clothing, and that has built in padding, ensures a safer environment, such as to participate in sports, with more protection then wearing no padding at all.

Therefore, there is a need for a garment for children and adults to wear when they are trying to maintain protection that may comprise impact due to falling or crashing, without the option of removing protective pads or being restrained by heavy padding that is worn over or under your existing garments.

SUMMARY

The present disclosure provides a garment, e.g., a pant or pants, that combines a durable fabric with hidden padded areas of the garment for protection from impact injury.

The garments described herein provide a blended fabric comprising at least one part synthetic woven fabric and an inner lining of synthetic knit, which, when affixed with a padded material such as foam, provides a garment construction suitable for applications where padding to prevent impact from injury is desired.

As further described herein, the padding may be hidden from the outside of the garment, giving the user the ability to make it seem as if they are not wearing any protective padding in a discreet, low profile manner and non visible at most substantial angles and not intended to be seen by the naked eye.

As described herein, construction of a garment suitable for sports or leisure using the disclosed fabric in combination with an inner lining of synthetic knit with protective padding panels also results in a final garment having improved mobility, a greater flexibility and freedom of movement for the wearer, and decreased muscle fatigue for the wearer. Additionally, the impact protection properties of the garment are maintained in order to keep the wearer protected during sports and/or activities.

The present disclosure also provides, a method of manufacturing a garment, e.g., a pant or pants, suitable for sports or leisure comprising affixing one or more panels of padded material to an inner lining of synthetic fabric wherein the padded material is affixed and hangs inside of the main garment. The methods used to construct the garment includes a sewing method of stitching thread to affix the padding to be held on to the hanging lining inside the pant. Another method that could be used would include affixing the pads by method of glue, or glue substrate. Either method would ensure the padded material would stay in place within the garment, and ensure protective padding would remain in optimal location to protect the specific areas of the body that are most prone to impact injury such as hips, tailbone, knees, and shins. The hanging liner would then be affixed by sewing to the underside of the inside waistband, where the user wears the pant the most secure and tight, to ensure the pants do not fall down from their waist line. Methods described herein further comprise blending the outer layer fabric with a combination of durable synthetic fabric and a more comfortable natural fiber such as cotton.

BRIEF DESCRIPTION OF THE DRAWINGS

Certain prior art padded garments for sports are constructed to be worn under the normal clothing of the user, as they are not designed to be worn on their own, but only in conjunction with the covering by a uniform, or other clothing or placement on the outside of clothing.

For certain applications such as sports conducted in impact positions, the use of pads is needed, but the only option might be to wear larger constructed padding over the normal clothing of the user. One example might be kneepads over the users clothing. The combination of these two garments restricts the user from having all the flexibility of their body and muscles that are required to perform at their highest level. A protective garment comprising an outside layer of traditional looking pant having an affixed inner lining of fabric, wherein the inner lining fabric is hidden and comprised of synthetic knit, the inside lining having padded panels affixed on to it, so that it will not be visible from the outside view of the garment. The protective garment of Claim 1, wherein the hanging liner with pads affixed on it, is arranged to protect the wearer from most prone injury areas. The protective garment of Claim 1, wherein the padding is hidden from the outside of the garment. The protective garment of Claim 1, wherein the hidden pads are affixed to the inside liner by method of sewing or heat gluing. The method by which the padding is affixed to the inside of the garment, but sewing or gluing the padding to a hanging lining, so that no fixing methods can be detected by the outside of the garment, such as glue marks or stitching lines. The protective garment of Claim 1, wherein the outer fabric is comprised of a synthetic woven fabric, or natural fiber, or combination thereof or blended with an additional synthetic or natural fiber. The protective garment of Claim 1, wherein the protective garment is for sport activity. The protective garment of Claim 2 wherein the injury areas comprise the tailbone, knees, and hipbone. The protective garment of Claim 5, wherein the outer fabric comprises a combination of synthetic woven fabric and natural fiber. The protective garment of Claim 7, wherein the natural fiber is cotton. A method of manufacturing a protective garment, comprising a hanging liner with affixed pads on it, which is hung inside of pants so that the padding is not visible, or the padding affixation method is also not visible, from the outside of the garment.

These and other features, aspects and advantages of the embodiments of the protective garment are described in detail below with reference to the drawings of certain embodiments. The figures and descriptions are intended to illustrate certain aspects, advantages, and novel features of the garment without limiting it

DETAILED DESCRIPTION

Figure 1B:
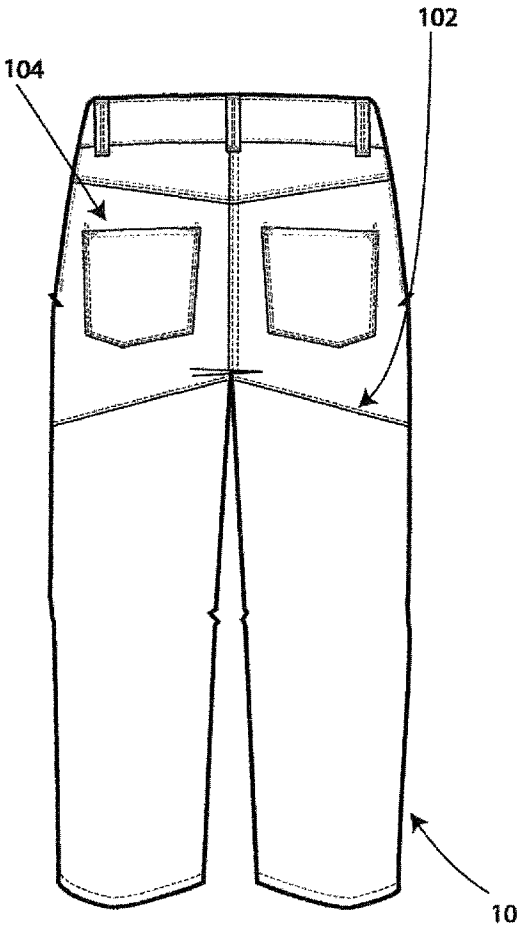
FIG. 1B is a rear schematic view of the outside of one embodiment of the garment.
Figure 1A:
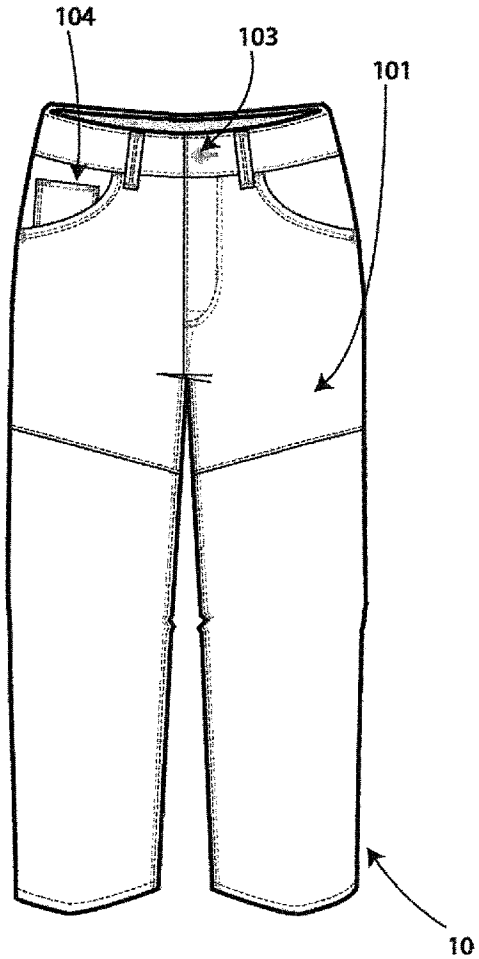
FIG. 1A is a front schematic view of the outside of one embodiment of the garment.
Figure 2B:
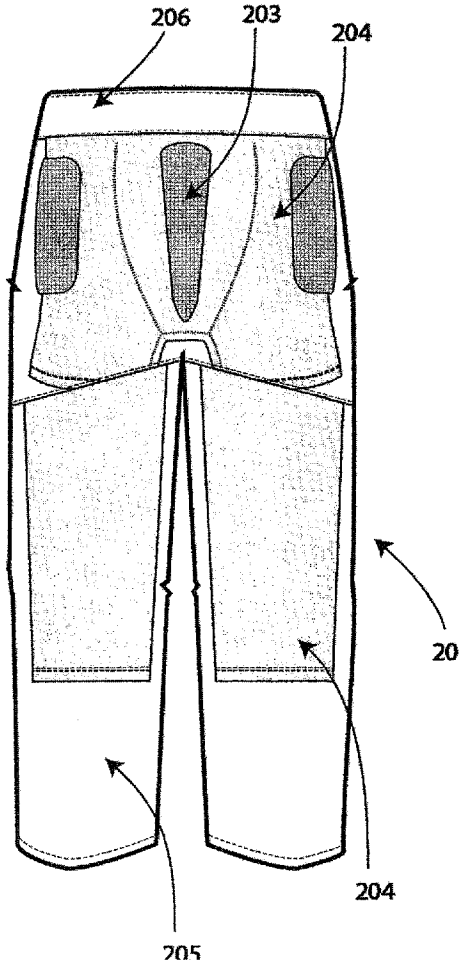
FIG. 2B is a rear schematic view of the interior of one embodiment of the garment, showing the internal padding sections.
Figure 2A:
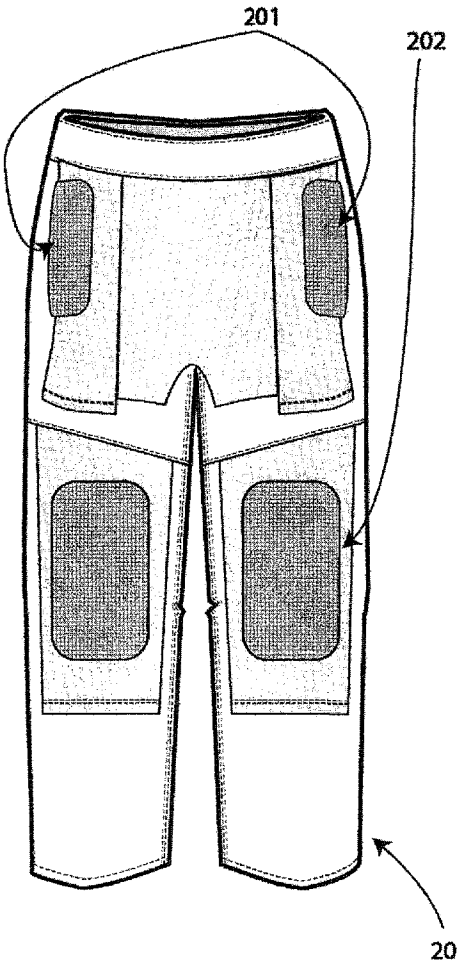
FIG. 2A is a front schematic view of the interior of one embodiment of the garment, showing the internal padding sections.

FIGS. 1*a*-2*b* illustrate a novel garment for use in the participation of sport or leisure applications. Although this padding is principally shown and described in conjunction hidden sewn in a casual pant, it would be understood that many of the inventive aspects can readily be adapted to other styles, such as shirts, hats, or shorts As illustrated in FIGS. 1 and 2, the garment has an inner lining(s) of synthetic knit fabric 103 and an outer layer of synthetic and or cotton blended woven fabric 101. The synthetic knit comprises nylon, polyester, or any combination thereof. Attached to the inner layer is a layer of a padded material 201, 202, and 203. The inner knit lining 204 and outer pant layer 101 is attached by stitching at waistband 206 for the upper lining, and at thigh seam 102 for the knee sleeve. The construction of these layers results in a garment with improved mobility and wearer protection than conventional materials used in the construction of protective garments.

As a testing and polling method, five professional athletes and five amateur athletes were given a pant garment as described herein and substantially similar to that of FIGS. 1 and 2, to try while performing their respective sports, including skateboarding, BMX bike riding, and scooter riding to gain insight as to how they felt the invention worked for them in comparison to the existing, bulky pads they were accustomed to wearing, or no protective padding at all. One hundred percent of these athletes agreed that the invention felt much better to participate in because they increased their mobility and the padding has been reinforced in the highest impact points for injury. Most athletes do not use padding for their tailbone and hip area in most circumstances, making the invention a standout product designed specifically with injury impact in mind. When the testers did not wear any padded apparel, they felt more susceptible to injury, and felt more pain when they fell down while performing tricks, or just in recreational activities.

Athlete Testing Results

Garment with hidden protective pads VS. Non-padded pants

| COMPARISON | Padded Pants | NON PADDED PANTS |
|---|---|---|
| Hurts less upon impact | 100% agree | |
| Reinforces impact zones | 100% agree | |
| Ease of use | 100% agree | |
| Feeling of safety/security | 100% agree | |
| Padding placement | 100% agree | |
| Less invasive | 100% agree | |

Garment with hidden protective pads vs. bulky pads

| Comparison | Padded Pants | Bulky Pads |
|---|---|---|
| Improved mobility | 100% agree | |
| Attractive to wear | 100% agree | |
| Ease of use | 100% agree | |
| Greater comfort | 100% agree | |
| Padding placement | 100% agree | |
| Less invasive | 100% agree | |
| Multi protection locations | 100% agree | |

In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the inventions herein disclosed should not be limited by the particular disclosed embodiments described above.

What is claimed is:

1. A protective garment comprising:

an outside layer of traditional looking pant having a built-in, partially affixed inner lining of fabric, the inner lining comprising an upper lining and a knee sleeve, the upper lining and the knee sleeve being unattached to one another;

wherein the upper lining hangs from the pant unaffixed along at least one edge and wherein the knee sleeve hangs from the pant unaffixed along at least one edge, wherein the upper lining and the knee sleeve are hidden from the outside of the garment and comprised of synthetic knit, wherein at least one of the upper lining and the knee sleeve has a padded panel affixed thereon;

wherein the upper lining is affixed to the outside layer at a first seam by stitching such that the outside layer and the upper layer are securely attached and are configured to be positioned on the body simultaneously; and wherein the knee sleeve is affixed to the outer layer along a second seam, separate from the first seam, of the pant by stitching such that the outside layer and the knee sleeve are securely attached and are configured to be positioned on the body simultaneously.

2. The protective garment of claim 1, wherein the hanging inner liner with padded panel affixed on it is arranged such that the padded panel is placed to protect at least one of the following injury-prone areas of a wearer: the hips, knees, shins, and tailbone areas.

3. The protective garment of claim 1, wherein the padded panels are hidden from the outside of the garment and not visible by the naked eye.

4. The protective garment of claim 1, wherein the padded panel is affixed to at least one of the knee sleeve and the upper liner by sewing or heat gluing so that no fixing methods can be detected from the outside of the garment, such as glue marks or stitching lines.

5. The protective garment of claim 1, wherein the outside layer is comprised of a synthetic woven fabric, or natural fiber, or combination thereof or blended with an additional synthetic or natural fiber.

6. The protective garment of claim 1, wherein the protective garment is configured for at least one of the following uses: action sports, traditional sports, leisure activities, fashion, and occupational uses.

7. The protective garment of claim 2 wherein the injury-prone areas comprise the tailbone, knees, and hipbone.

8. The protective garment of claim 5, wherein the outside layer comprises a combination of synthetic woven fabric and natural fiber.

9. The protective garment of claim 8, wherein the natural fiber is cotton.

10. A method of manufacturing a protective garment comprising pant or pants suitable for sports or leisure activities, the method comprising:

partially affixing an inner lining of synthetic material inside the protective garment, the inner lining comprising an upper lining and a knee sleeve, so that the inner lining is not visible when worn and so that the inner lining hangs from the inside of the protective garment;

wherein the upper lining and the knee sleeve are unattached to one another;

wherein partially affixing the inner lining comprises partially affixing the upper lining inside the protective garment at a first seam of the protective garment and partially affixing a knee sleeve inside the protective garment at a second seam of the protective garment, separate from the first seam; and affixing one or more panels of padded material to the inner lining, such that the padded material hangs inside of the protective garment.

11. The method of claim 10, wherein a sewing method of stitching thread is used to affix the one or more panels of padded material to the hanging inner lining inside the protective garment.

12. The method of claim 10, wherein glue or a glue substrate is applied to affix the one or more panels of padded material to the hanging inner lining inside the protective garment.

13. The method of claim 10, wherein the one or more panels of padded material are arranged within the garment so as to protect at least one of the following injury-prone areas of a wearer of the garment: the hips, knees, shins, and tailbone areas.

14. The method of claim 10, further comprising forming an outer pant layer of the garment, wherein the outer pant layer is formed of a blend of synthetic woven fabric and natural fiber.

15. The protective garment of claim 1, wherein the upper lining has at least one padded panel affixed thereon, arranged such that the padded panel is placed to protect at least one of the following injury-prone areas of a wearer: the hips and the tailbone areas.

16. The protective garment of claim 1, wherein the knee sleeves has at least one padded panel affixed thereon, arranged such that the padded panel is placed to protect at least one of the following injury-prone areas of a wearer: the knee areas and the shin areas.

17. The protective garment of claim 1, wherein the first seam is a waistband of the pant and the second seam is a thigh seam of the pant.

18. The method of claim 10, wherein the first seam is a waistband of the pant and the second seam is a thigh seam of the protective garment.

* * * * *